US006464418B1

(12) United States Patent
Visser et al.

(10) Patent No.: US 6,464,418 B1
(45) Date of Patent: Oct. 15, 2002

(54) DOCKABLE CONTAINER AND METHOD OF REFRESHING EYE MAKEUP

(76) Inventors: Shelly M. Visser, 10304 W. 62nd St., Arvada, CO (US) 80004; Debra B. Visser, 11917 Keough Dr., Northglenn, CO (US) 80233; Nori Johansen, 16359 W. 10th Ave., Golden, CO (US) 80401

( * ) Notice: Subject to any disclaimer, the term of this patent is extended or adjusted under 35 U.S.C. 154(b) by 0 days.

(21) Appl. No.: 09/519,207

(22) Filed: Mar. 6, 2000

Related U.S. Application Data

(63) Continuation-in-part of application No. 09/030,368, filed on Feb. 24, 1998, now abandoned.
(60) Provisional application No. 60/039,874, filed on Mar. 5, 1997.

(51) Int. Cl.[7] ..... B65D 21/00
(52) U.S. Cl. ..... 401/34; 401/18; 220/23.83; 206/509
(58) Field of Search ..... 401/34, 17, 18, 401/122, 126, 130; D28/76, 77; 220/23.83, 23.4; 206/509, 511

(56) References Cited

U.S. PATENT DOCUMENTS 1,681,810 A * 8/1928 Nelson ..... 401/130
2,636,633 A * 4/1953 Carlson ..... 220/23.4
2,753,077 A * 7/1956 Greco ..... 206/509
3,341,884 A * 9/1967 Pryor ..... 401/17
3,363,635 A * 1/1968 Wurmbock ..... 401/122
4,130,200 A * 12/1978 Iepson et al. ..... 220/23.83
4,373,633 A * 2/1983 Lutz, Sr. ..... 206/509
4,573,595 A * 3/1986 Mednis ..... 206/509
4,826,263 A * 5/1989 Speraw ..... 220/23.4
D311,787 S * 10/1990 Cassai et al. ..... D28/77
4,981,214 A * 1/1991 Rojas ..... 206/509
5,823,391 A * 10/1998 Klauke et al. ..... 220/23.4
5,954,213 A * 9/1999 Gerhart et al. ..... 220/23.4

* cited by examiner

*Primary Examiner*—Charles R. Eloshway
(74) *Attorney, Agent, or Firm*—Dorsey & Whitney LLP

(57) ABSTRACT

A dockable storage container for storing solids, powders, liquids and the like includes a housing defining a storage chamber having an opening to provide access to the storage chamber, a cap for closing the opening to the storage chamber and a unisex docking mechanism for releasably docking with a structurally identical unisex docking mechanism of another container so that the containers align with each other when they are docked. A method of refreshing eye makeup includes providing eye makeup liquid remover disposed within a first hollow container and having a first applicator disposed therein, providing eye makeup refreshing powder disposed within a second hollow container connected to the first hollow container and having a second applicator disposed therein, applying the eye makeup remover with the first applicator to remove unwanted makeup, and applying the eye makeup refreshing powder with the second applicator to refresh areas contacted with the eye makeup remover.

10 Claims, 5 Drawing Sheets

DOCKABLE CONTAINER AND METHOD OF REFRESHING EYE MAKEUP

This application is a nonprovisional application claiming the benefit under 35 USC 119(e) of U.S. provisional application Ser. No. 60/039,874, filed on Mar. 5, 1997, as well as a continuation-in-part application of U.S. patent application Ser. No. 09/030,368, which was filed on Feb. 24,1998, now abandoned.

TECHNICAL FIELD

The present invention relates generally to containers and, more particularly, to storage containers for storing solids, powders, liquids and the like such as makeup.

BACKGROUND OF THE INVENTION

Storage containers designed for storing solids, powders, liquids and the like, such as eye makeup, that fit conveniently within a woman's purse are known in the art. Such containers are often elongated and sometimes include a cap that incorporates an applicator brush or sponge. However, existing makeup containers have a significant drawback. Sometimes a woman wishes to apply a first substance, such as makeup remover, followed by a second substance, such as makeup refresher. When these substances are stored in separate containers, a woman must search through the contents of her purse and locate both containers.

This drawback can be overcome by joining the two containers together to form a single unit having two separate storage chambers. However, if the two containers are permanently joined, another drawback is presented. The container holding the first substance is permanently joined with the container holding the second substance, and it cannot be alternatively joined with containers holding different substances. The ability to do so is desirable. For example, on one evening, a woman may wish to carry blue eyeliner and blue eye shadow in her purse, but on a second evening, she may wish to replace the blue eye shadow with green eye shadow. If the makeup containers can be universally docked with one another by use of unisex docking means, then a woman is free to choose whatever combination of substances she desires without having to maintain multiple containers of the same substance.

DISCLOSURE OF THE INVENTION

One object of the present invention is to provide a dockable storage container for storing solids, powders, liquids and the like. In its broadest sense the dockable storage container includes a housing defining a storage chamber having an opening to provide access to the storage chamber, closure means for closing the opening to the storage chamber, and unisex docking means for releasably docking with structurally identical unisex docking means of another container so that the containers are in alignment with each other when they are docked.

A second object of the present invention is to provide a dockable storage container wherein the housing is generally elongated and has generally oppositely facing open and closed ends with the unisex docking means located at the closed end of the housing. This allows two containers to be docked at their closed ends while still permitting access to the storage chambers through the open ends.

A third object of the present invention is to provide a dockable storage container wherein the opening is closed by means of a cap that is releasably engageable with the housing. The cap may seal the storage chamber. The cap may also incorporate an applicator member that extends from the cap such that when the cap is engaged on the housing, the applicator member extends into the storage chamber.

A further object of the present invention is to provide a method of refreshing eye makeup. In its broadest sense, the method includes the following steps: (a) providing eye makeup liquid remover disposed within a first hollow container and having a first applicator disposed therein; (b) providing eye makeup refreshing powder disposed within a second hollow container connected to the first hollow container and having a second applicator disposed therein; (c) applying the eye makeup remover with the first applicator to remove unwanted makeup; and (d) applying the eye makeup refreshing powder with the second applicator to refresh areas contacted with the eye makeup remover.

A still further object of the present invention is to provide a method as previously described wherein the first and second containers are not permanently connected with one another. Accordingly, each of the containers may include unisex docking means that releasably engage the containers. This allows an empty container to be disposed of without disposing of the other container and a new container having the same unisex docking means to be docked to the remaining container.

These and other features and advantages of the present invention will become apparent to those skilled in the art upon a reading of the following detailed description when taken in conjunction with the drawings, wherein there are shown and described several illustrative embodiments of the invention.

BRIEF DESCRIPTION OF THE DRAWINGS

In the following detailed description of the best mode for carrying out the invention, reference will be made to the attached drawings in which.

BEST MODE FOR CARRYING OUT THE INVENTION

Figure 1:
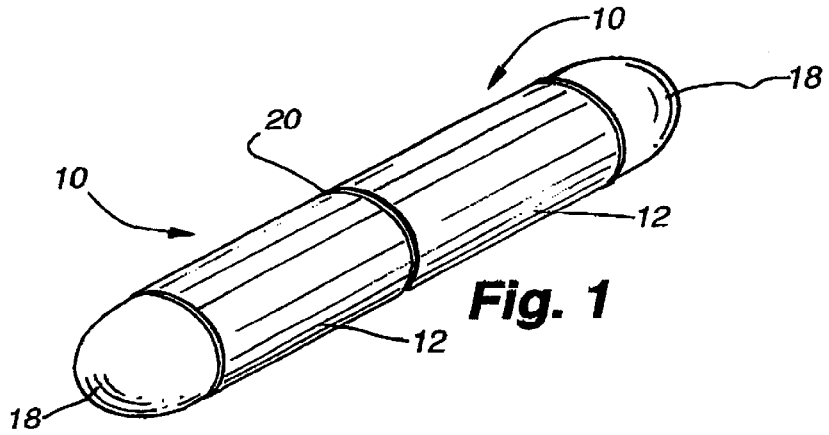
FIG. 1 is a perspective view showing two dockable storage containers of a first embodiment of the present invention each having a first unisex docking means with the containers shown docked with one another.
Figure 2:
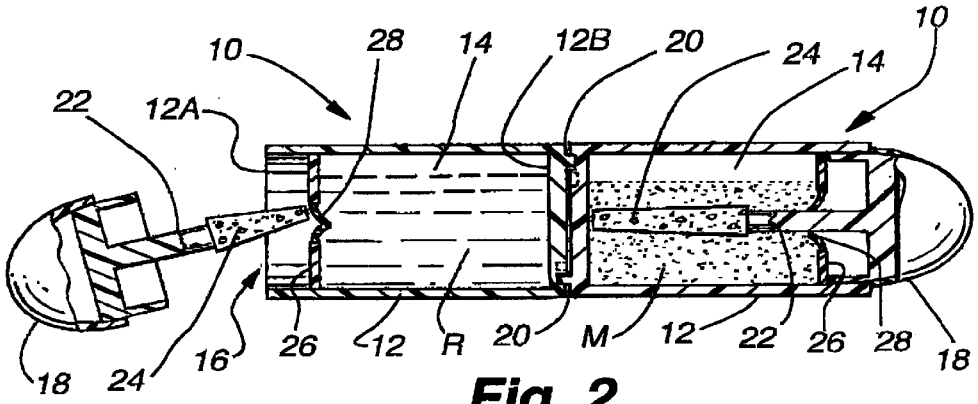
FIG. 2 is a cross-sectional side view of the dockable storage containers of FIG. 1.
Figure 4:
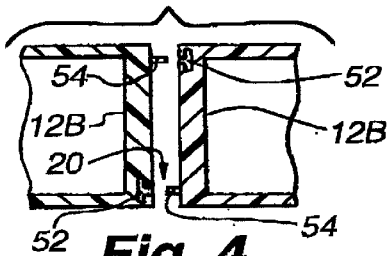
FIG. 4 is a side cross-sectional view showing a portion of the dockable storage containers of FIG. 1 with the containers shown undocked.

Referring now to FIGS. 1, 2, and 4, a pair of dockable storage containers of a first embodiment of the present invention generally designated by the numeral 10 are shown. Each container 10 includes a housing 12 defining a storage chamber 14 for storing solids, powders, liquids and the like therein. The housing 12 includes an opening 16 that provides access to the storage chamber 14. Each container 10 also includes closure means, such as a cap 18, for closing the opening 16 and unisex docking means 20 for releasably engaging unisex docking means 20 of the other container 10 to enable docking and undocking of the containers 10.

The housing 12 is generally elongated and cylindrically shaped and has oppositely facing open and closed ends 12A, 12B, with access to the storage chamber 14 through the open end 12A. The unisex docking means 20 is located at the closed end 12B of the housing 12. The cap 18 is dome-shaped and is releasably engageable with the housing 12. When the cap 18 is engaged on the housing 12, it seals the storage chamber 14, thereby preventing solids, powders, liquids and the like from leaking out of the storage chamber 14.

The dome-shaped cap 18 incorporates an applicator member 22 that extends into the storage chamber 14 when the cap 18 is engaged on the housing 12. The applicator member 22 has a sponge 24 at its end for applying the contents of the chamber. An annular flange 26 is disposed within the housing 12 adjacent to the open end 12A. The annular flange 26 defines a larger portion of the storage chamber 14 between the flange 26 and the closed end 12B of the housing 12 and a smaller portion of the storage chamber 14 between the flange 26 and the open end 12A of the housing 12. An aperture 28 is formed through the flange 26 for receiving the applicator member 22 so that when the cap 18 is engaged on the housing 12, the applicator member 22 extends through the aperture 28 into the larger portion of the storage chamber 14. It should be appreciated that although a container 10 of the first embodiment is adapted for storing substances such eye makeup M, including mascara, eye liner and eye shadow, liquid eye makeup remover R, or makeup refreshing powder (not shown), many other substances may be stored therein.

The unisex docking means 20 shown in FIGS. 2 and 4 includes an arcuate slot 52 formed in the housing 12 at the closed end 12B thereof and a T-shaped projection 54 extending from the closed end 12B of the housing 12. To dock a container 10 with another container 10, the arcuate slot 52 in the closed end 12B of one container 10 receives a T-shaped projection 54 extending from the closed end 12B of the other container 10 while the T-shaped projection 54 of the first container is received in the arcuate slot 52 formed in the closed end 12B of the other container 10. The containers are then twisted, i.e. rotated in opposite directions relative to each other so that the posts (not numbered) of the T-shaped projections 54 slide to the other ends of the slots 52. This twisting action locks the T-shaped projections in the slots, thereby securely docking the containers together.

It will also be appreciated as illustrated in FIGS. 1–4 that unisex docking means 20 docks the containers so that they are in alignment with each other when they are docked. That is, the containers longitudinal axes will be aligned with each other when the containers are docked. This is an important feature of the docking means of the present invention because it insures that the containers form a single easily grasped object when they are docked.

Figure 3:
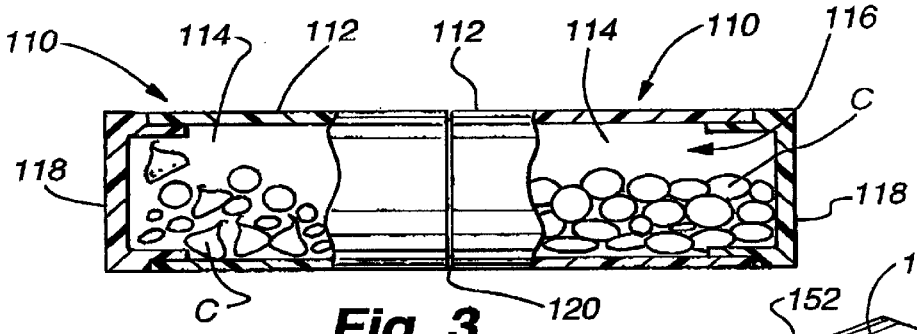
FIG. 3 is a side view shown in partial cross-section of two dockable storage containers of a second embodiment of the present invention each having the first unisex docking means with the containers shown docked with one another.
Figure 5:
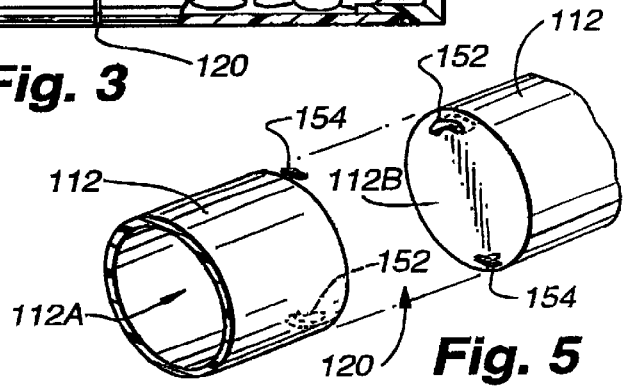
FIG. 5 is a perspective view showing a portion of the dockable storage containers of FIG. 3 with the containers shown undocked.

Referring now to FIGS. 3 and 5, a pair of dockable containers of a second embodiment of the present invention generally designated by the numeral 110 are shown. As with the first embodiment, each container 110 includes a generally elongated cylindrically-shaped housing 112 defining a storage chamber 114 for storing solids, powders, liquids and the like therein. The housing 112 includes an opening 116 that provides access to the storage chamber 114. Each container 110 also includes closure means, such as a cap 118, for closing the opening 116 and unisex docking means 120 for releasably engaging unisex docking means 120 of the other container 110 to enable docking and undocking of the containers 110.

The housing 112 of each container 110 has oppositely facing open and closed ends 112A, 112B. There is access to the storage chamber 114 through the open end 112A. The unisex docking means 120 is located at the closed end 112B of the housing 112. Unlike the first embodiment, the cap 118 is flat and does not include an applicator member 22. Furthermore, there is no annular flange 26 disposed within the housing 112. It will be appreciated that a container 110 of the second embodiment is more suitable for storing a substance, such as candy C, than it is for storing mascara M or liquid eye makeup remover R. However, such substances as well as many others may be stored within a container 110 of the second embodiment.

The unisex docking means 120 shown in FIG. 5 is the same as that of FIGS. 2 and 4 and therefore has an arcuate slot 152 formed in the housing 112 at the closed end 112B thereof and a T-shaped projection 154 extending from the closed end 112B of the housing 112. While not specifically discussed above, the term "unisex docking means" as used herein means that the docking means of one container must be capable of docking with a structurally identical docking means of another container. Accordingly, if the docking means of one container has a T-shaped projection and an arcuate slot as discussed above, the other container must also have a T-shaped projection and arcuate slot and they must be structurally identical to those of the first container.

Figure 6:
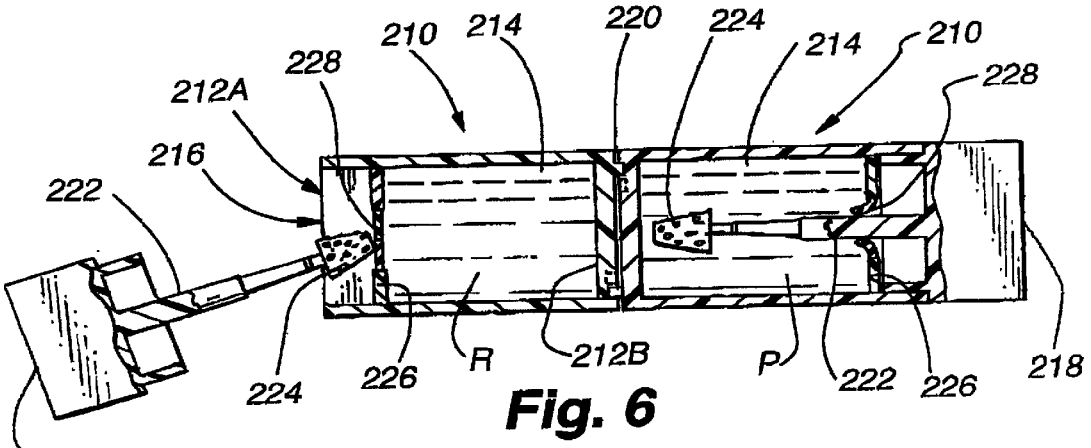
FIG. 6 is a side cross-sectional view showing two dockable storage containers of a third embodiment of the present invention each having the first unisex docking means with the containers shown docked with one another.
Figure 7:
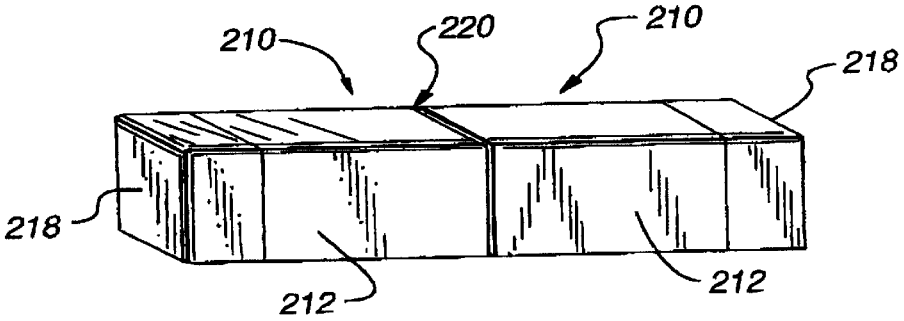
FIG. 7 is a perspective view of the dockable storage containers of FIG. 6.
Figure 8:
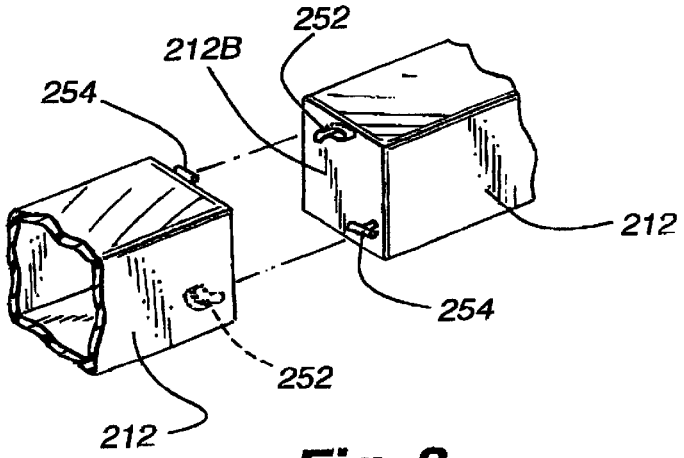
FIG. 8 is a perspective view showing a portion of the dockable storage containers of FIG. 6 with the containers shown undocked.

Referring now to FIGS. 6–8, a pair of dockable containers of a third embodiment of the present invention generally designated by the numeral 210 are shown. Each dockable container includes a generally elongated rectangularly-shaped housing 212 defining a storage chamber 214 for storing solids, powders, liquids and the like therein. The housing 212 has oppositely facing open and closed ends 212A, 212B and includes an opening 216 that provides access to the storage chamber 214. Each container 210 also includes closure means, such as a cap 218, for closing the opening 216 and unisex docking means 220 for releasably engaging unisex docking means 220 of the other container 210 to enable docking and undocking of the containers 210.

As with the previous embodiments, the unisex docking means 220 of each container 210 is located at the closed end 212B of the housing 212. The cap 218 is rectangularly shaped and incorporates an applicator member 222 that extends into the storage chamber 214 when the cap 218 is engaged on the housing 212. The applicator member 222 has a sponge 224 at its end. An annular flange 226 is disposed within the housing 212 adjacent to the open end 212A. The annular flange 226 defines a larger portion of the storage chamber 214 between the flange 226 and the closed end 212B of the housing 212 and a smaller portion of the storage chamber 214 between the flange 226 and the open end 212A of the housing 212. An aperture 228 is formed through the flange 226 for receiving the applicator member 222 so that when the cap 218 is engaged on the housing 212, the applicator member 222 extends through the aperture 228 into the larger portion of the storage chamber 214. A container 210 of the third embodiment is adapted for storing substances such as eye makeup, including mascara, eye liner and eye shadow (not shown), liquid eye makeup remover R, or makeup refreshing powder P. However, many other different substances may be stored therein.

Again, the unisex docking means 220 shown in FIGS. 6 and 8 is the same as that of the previous embodiments and thus has an arcuate slot 252 formed in the housing 212 at the closed end 212B thereof and a T-shaped projection 254 extending from the closed end 212B of the housing 212. Therefore, to dock a pair of containers 210 together, the projections 254 on the containers are inserted into the slots 252 and the containers are then twisted, i.e., rotated in opposite directions relative to each other so that the projections are locked to the slots, thereby securely docking the containers to each other.

Figure 9:
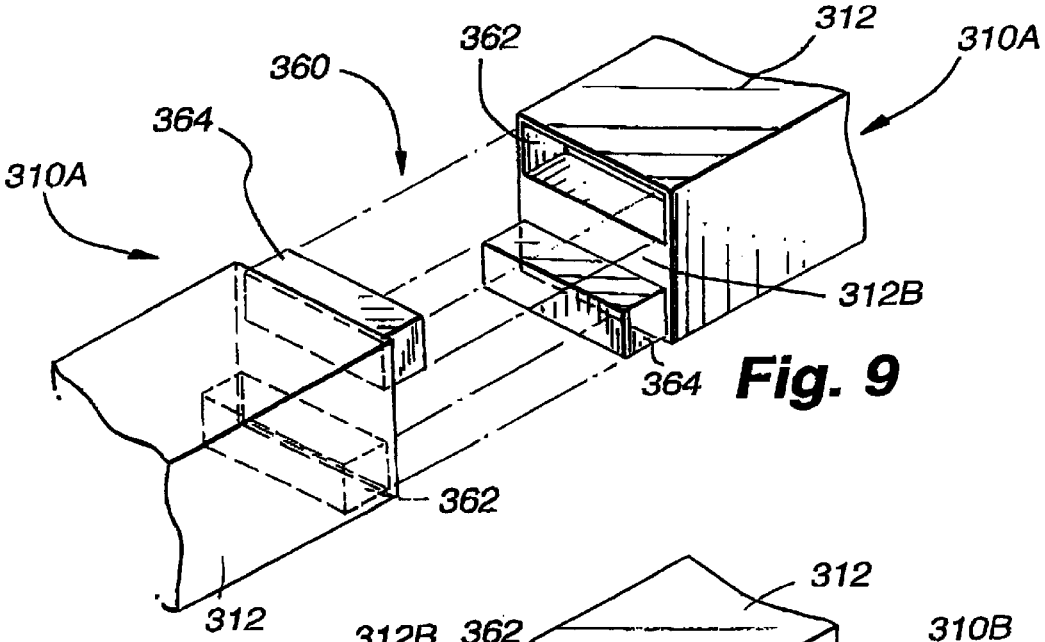
FIG. 9 is a perspective view showing a portion of the dockable storage containers of FIG. 6 having a first variant of a second unisex docking means with the containers shown undocked.
Figure 10:
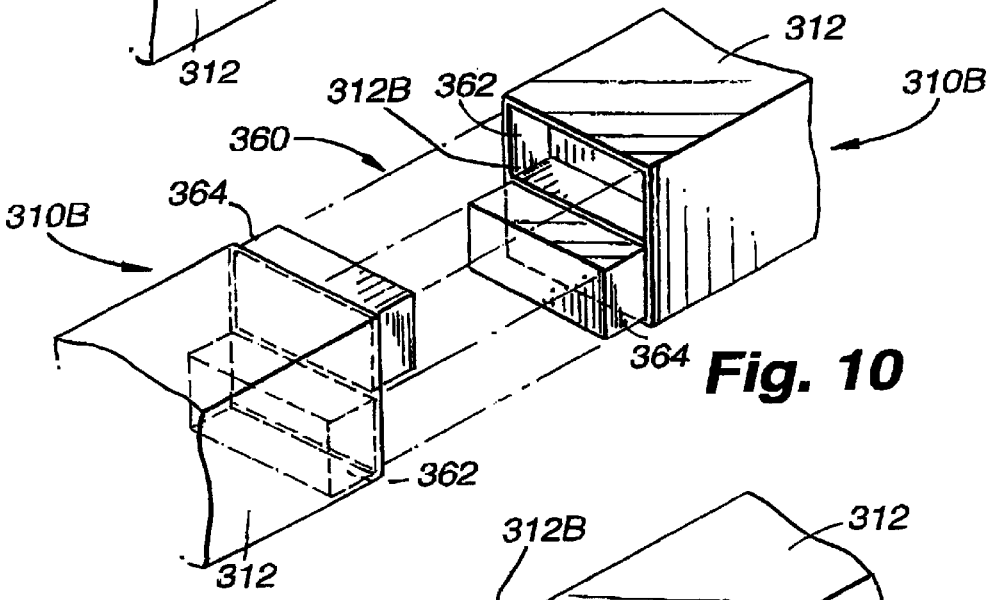
FIG. 10 is a perspective view showing a portion of the dockable storage containers of FIG. 6 having a second variant of the second unisex docking means with the containers shown undocked.
Figure 11:
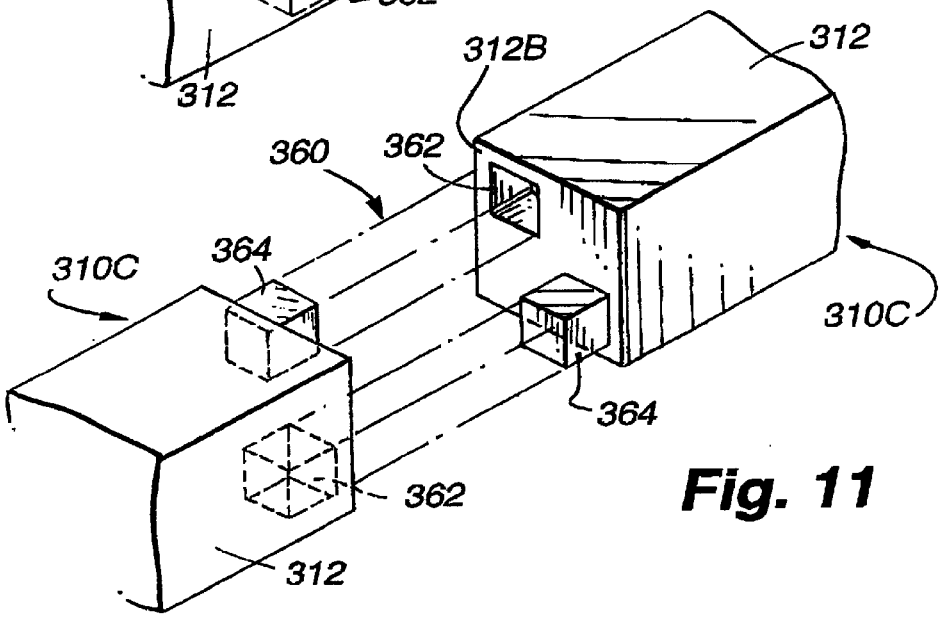
FIG. 11 is a perspective view showing a portion of the dockable storage containers of FIG. 6 having a third variant of the second unisex docking means with the containers shown undocked.

Referring now to FIGS. 9–11, in addition to unisex docking means 20, 120, and 220, the present invention also provides a second unisex docking means 360 for docking a container 310A (FIG. 9) to another container 310A. While shown in FIG. 9 docking a pair of containers 310A, two other variants or versions of the second unisex docking means 360 are shown in FIGS. 10 and 11, i.e., containers 310B and 310C. Use of the second unisex docking means 360 is not restricted to these containers. As will be appreciated, it may also be used in containers 10, 110, and 210 of the previous embodiments.

The second unisex docking means 360 includes a rectangularly shaped hole 362 formed in the housing 312 at the closed end 312B thereof and a rectangularly shaped projection 364 extending from the closed end 312B of the housing 312. The rectangularly shaped hole 362 receives the rectangularly shaped projection 364 extending from the closed end 312B of the housing 312 of the other container 310A, 310B, or 310C, and the rectangularly shaped projection 364 is received in the rectangularly shaped hole 362 formed in the closed end 312B of the housing 312 of the other container 310A, 310B, or 310C when the two containers are docked with one another. As is shown in FIGS. 9–11, the rectangularly shaped hole 362 and projection 364 may be of a variety of rectangular shapes, ranging from smaller rectangles as depicted in FIG. 9, to larger rectangles as shown in FIG. 10, to small squares as shown in FIG. 11.

Figure 12:
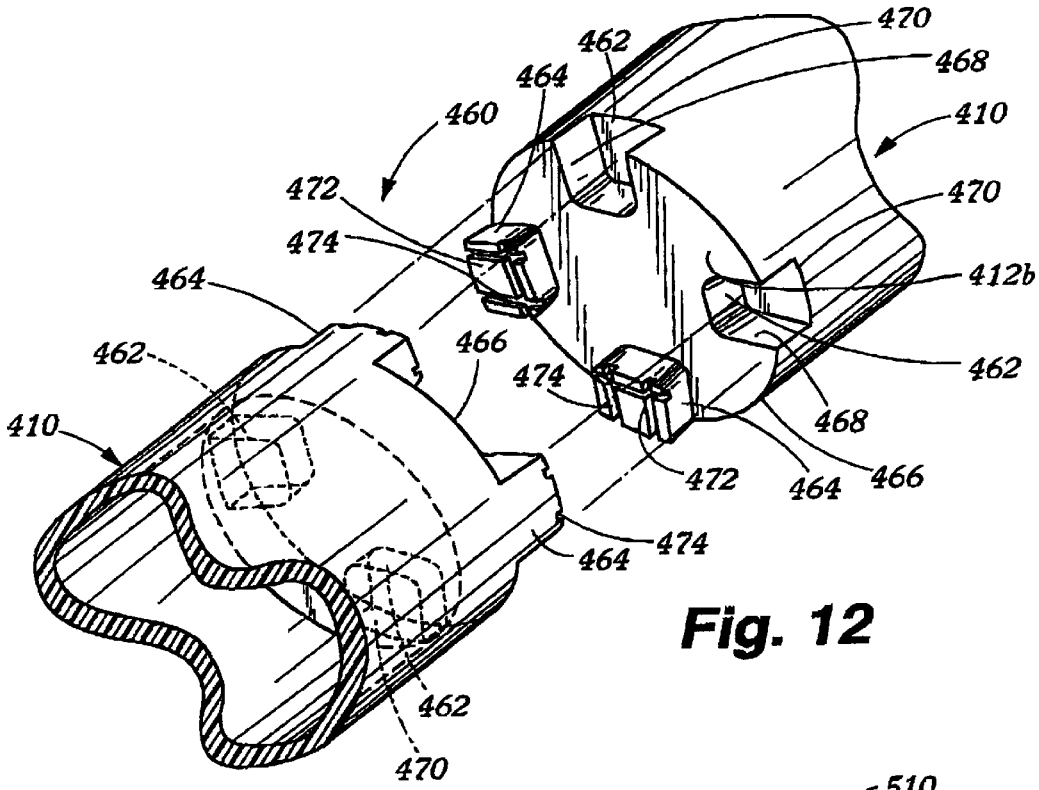
FIG. 12 is a partially broken away perspective view showing a first variant of a third unisex docking means of the present invention for containers similar to those of FIGS. 1–11.

FIG. 12 illustrates a first variant of a third unisex docking means 460 of the present invention, which while somewhat similar to unisex docking means 360 of FIGS. 9–11 differs in that the female and male docking members 462, 464 are respectively formed in and on the peripheral edge 466 of the closed end 412B of the container 410. The female docking member 462 is essentially a notch provided in the end edge 466. The female docking member or notch 462 has a U-shaped surface 468 which terminates to define a side opening 470. The male docking member 464 is a rectangular-shaped member projection which extends from the peripheral end edge 466 and is sized and configured for tight engaging receipt in the female docking member or notch 462.

Preferably, male docking member or projection 464 is slightly larger than notch 462 so that when it is inserted into the notch 462 of an identical container 410, tight engagement between the members is achieved, thereby securely docking a pair of containers 410 together. In addition, the end surface 472 of projection 464 is provided with slits 474 which cause the projection to compress slightly when it is inserted in the notch 462. This ability to compress facilitates insertion of the projection into the notch and is also believed to enhance the tightness of the engagement between the notch and the projection. Locating the notch and projection on the peripheral end edge 466 of the container has also been found to facilitate insertion of the projection into the notch by making it easier to align the containers to be docked.

Figure 13:
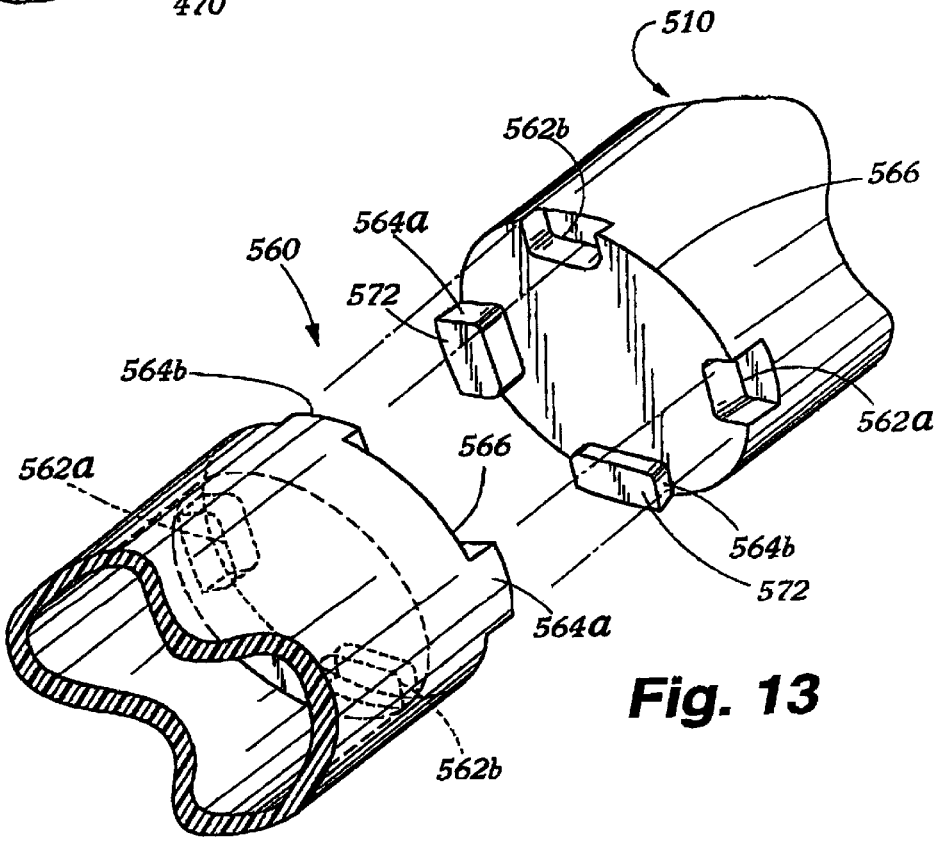
FIG. 13 is a partially broken away perspective view showing a second variant of the third unisex docking means of the present invention for containers similar to those of FIGS. 1–11.

The embodiment of FIG. 13 is similar to that of FIG. 12. In this second variant 560 of the third unisex docking means, however, the projections 564*a*, 564*b* formed on the peripheral edge 566 are not provided with slits 474 in the end surfaces 572 of projections 564*a*, 564*b*. While slits are desirable as discussed above, they are not necessary, and compressibility of the projection 564 can also be provided by making the container 510 out of a material which is compressible or resilient. In addition, it will be appreciated that notch 562*a* is deeper than notch 562*b*. Similarly, projection 564*a* is taller than projection 564*b*. Providing the projections and notches with different heights and depths is desirable because it makes it easier to align the containers and thereby easier to dock.

Figure 14:
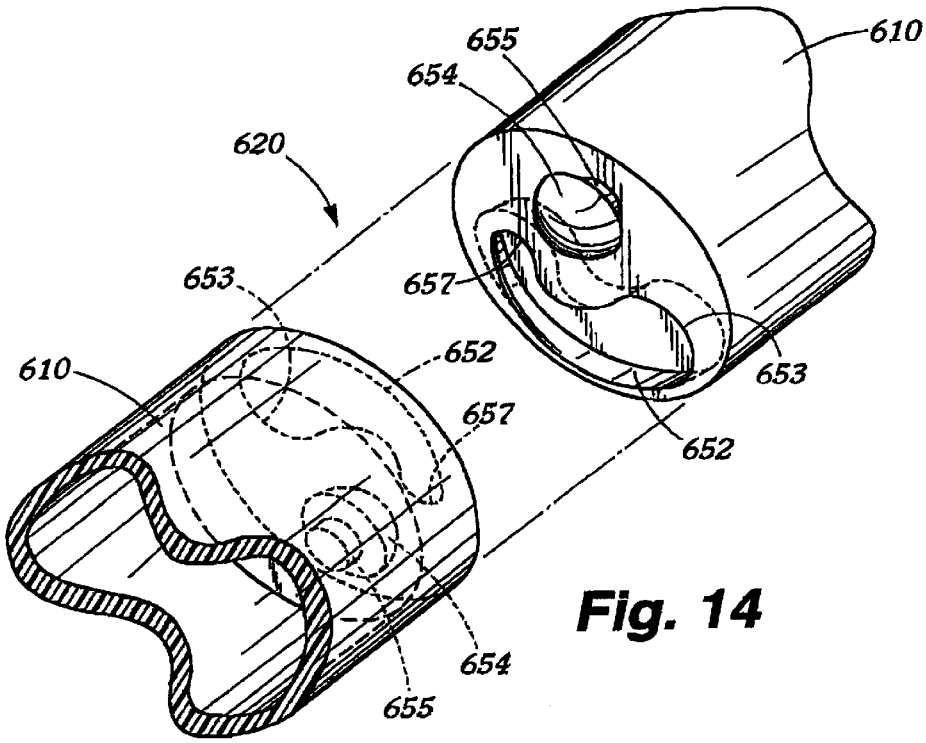
FIG. 14 is a partially broken away perspective view showing a fourth unisex docking means of the present invention for containers similar to those of FIGS. 1–11.

The unisex docking means 620 of FIG. 14 is similar to docking means 20, 120, and 220 of FIGS. 1–8 except that instead of using a T-shaped projection 54, 154, 254, this fourth embodiment employs a dome shaped member 654 which is inserted into the wide-mouthed end 653 of an arcuate slot 652 provided in the closed end of another elongated container 610. As with the containers of FIGS. 1–8, containers 610 are then twisted or rotated in opposite directions relative to each other so that the support posts 655 of the dome-shaped members slide into the narrow-mouthed ends 657 of the arcuate slots, thereby locking the dome-shaped members in the narrow-mouthed ends of the slots to securely dock the containers together.

Figure 15:
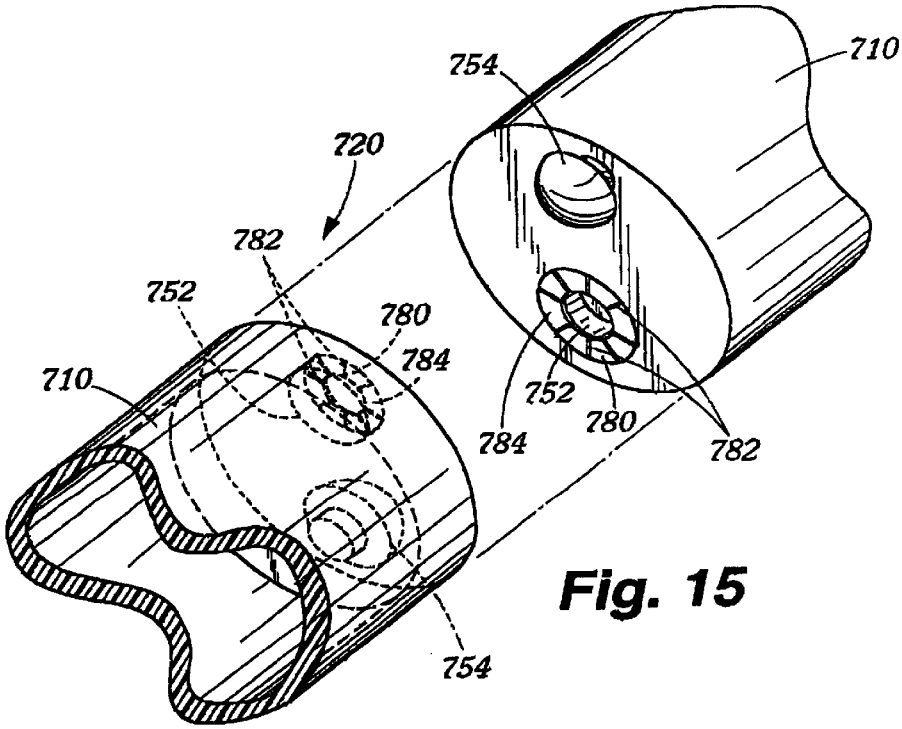
FIG. 15 is a partially broken away perspective view showing a fifth unisex docking means of the present invention for containers similar to those of FIGS 1–11.

FIG. 15 illustrates a fifth unisex docking means 720 of the present invention which may be used to dock any generally elongated container such as the illustrated containers 710. Docking means 720 includes a dome-shaped projection 754 similar to that of FIG. 14 which is received in a chamber 752 having a snap-in washer 780. Snap-in washer 780 is provided with slits 782 which enable the resilient washer sections 784 defined by each slit to deflect inwardly and thereby receive the dome-shaped member when it is inserted into chamber 752. When the dome-shaped members are fully inserted into their respective chambers 752, the deflected washer sections 784 will return to their undeflected position shown in FIG. 15 to lock the dome-shaped members in the chambers, thereby docking the containers together. When it is desired to separate the containers, the containers are simply pulled apart which causes the washer sections to deflect outwardly, thereby permitting the dome-shaped members to exit the chambers. As indicated, the washer 780 including its sections 784 must be made from a material having sufficient resiliency so that the washer sections can deflect inwardly and outwardly as discussed above.

A magnetic unisex docking means (not shown) may also be provided for containers similar to those previously disclosed herein. The magnetic unisex docking means would have a magnet (not shown) disposed at the container's closed end of the housing. The magnet would be oriented and polarized to attract an identical magnet disposed at the closed end of another similar container, thereby releasably docking the two such containers together.

Regardless of the embodiment of the foregoing containers, it will be appreciated that any two containers having structurally identical unisex docking means may be docked together. This allows a container such as container 10 holding mascara M to be docked with another container 10 holding liquid eye makeup remover R as is shown in FIG. 2, or two containers such as containers 110 holding different types of candy C as shown in FIG. 3, or two containers 210, one holding liquid eye makeup remover R and the other makeup refreshing powder P as shown in FIG. 6.

The present invention also contemplates a method of refreshing eye makeup. The method involves providing eye makeup liquid remover R disposed within a first hollow container having a first applicator disposed therein. The method also involves providing eye makeup refreshing powder disposed within a second hollow container connected to the first hollow container and having a second applicator disposed therein. Next, the eye makeup remover is applied with the first applicator to remove unwanted makeup such as smeared makeup. Then, the eye makeup refreshing powder is applied with the second applicator to refresh areas contacted with the eye makeup remover. Preferably, the eye makeup remover is mascara remover available from the Maybelline Company of Little Rock, Ark., and the refreshing powder is Maybelline Moisture Whip available from Maybelline Sales Inc. of Memphis, Tenn. Also, the first and second applicators are preferably provided with a sponge. In addition, each of the containers is preferably provided with unisex docking means to enable the containers to be releasably docked or engaged to each other.

It is believed that the present invention and its advantages will be understood from the foregoing description and it will be apparent that various changes may be made thereto without departing from the spirit and scope of the invention or sacrificing all of its material advantages, the form hereinbefore described being merely a preferred or exemplary embodiment thereof.

We claim:

1. A dockable storage container for storing solids, powders, and liquids, the container comprising:

a first elongated housing having a longitudinal axis, said housing defining a storage chamber having a closed end and an opening providing access to said storage chamber;

first reclosable means operative to reseal said opening;

first unisex docking means adapted to lockably and releasably dock with a structurally identical second unisex docking means of a second container comprising a second elongated housing, said first unisex docking means comprising a first T-shaped projection extending from the closed end of said first housing and a first arcuate slot formed in the closed end of said first housing;

the first T-shaped projection comprising a first post and first crosspiece, said first crosspiece adapted to fit within a second arcuate slot formed in a closed end of said second housing;

the first arcuate slot adapted to receive a second crosspiece of a second T-shaped projection extending from the closed end of the second housing; and the first housing adapted to rotate to bring the first post into contact with an end of the second arcuate slot.

2. A handheld dockable storage container for storing solids, powders, and liquids, said container comprising:

a generally elongated housing defining a storage chamber and having generally oppositely facing open and closed ends with access to said storage chamber through said open end;

closure means operative to reseal said open end after opening; and first unisex docking means defined at said closed end of said elongated housing, said unisex docking means being adapted to releasably dock with a second, structurally identical unisex docking means of a second container, the first unisex docking means comprising an arcuate slot formed in said housing at said closed end and a T-shaped projection extending from said closed end of said housing, said arcuate slot being adapted to receive a T-shaped projection extending from a closed end of a housing of the second container, and said T-shaped projection being adapted to be received in an arcuate slot formed in the closed end of the housing of the second container.

3. The container as claimed in claim 2, wherein said closure means comprises a cap releasably engageable with said housing.

4. The container as claimed in claim 3, wherein said cap includes an applicator member extending from said cap such that when said cap is engaged with said housing, said applicator member extends into said storage chamber defined by said housing.

5. The container as claimed in claim 4, wherein said applicator member includes a sponge.

6. The container as claimed in claim 4, further comprising an annular flange disposed within said housing adjacent to said open end to define a larger portion of said storage chamber between said flange and said closed end of said housing and a smaller portion of said storage chamber between said flange and said open end of said housing, said flange having an aperture formed therethrough for receiving said applicator member such that said applicator member extends through said aperture into said larger portion of said storage chamber when said cap is engaged on said housing.

7. A handheld, two-chamber storage unit for storing solids, powders, and liquids, said storage unit comprising:

a first generally elongated housing and a second generally elongated housing, each said first and second housing defining a separate storage chamber and having an open end and a closed end with access to said storage chamber being through said open end, said open ends of said first and second housings being generally oppositely facing, and said closed ends of said first and second housings being adjacent;

a first closure means operative to reseal said open end of said first housing after opening;

a second closure means operative to reseal said open end of said second housing after opening;

a first unisex docking means forming part of said first housing for releasably docking said first housing to said second housing, said first unisex docking means comprising a first T-shaped projection extending from the closed end of said first housing and a first arcuate slot formed in the closed end of said first housing; and a second unisex docking means forming part of said second housing for releasably docking said second housing to said first housing, wherein said second unisex docking means is structurally identical to said first unisex docking means.

8. The storage unit of claim 7, wherein said first closure means comprises a first cap and said second closure means comprises a second cap, said first cap being sealably and releasably engageable with said first housing, and said second cap being sealably and releasably engageable with said second housing.

9. The storage unit of claim 8, wherein each said cap includes an applicator member extending from said cap such that when said cap is engaged with one of said first and second housings, said applicator member extends into a corresponding one of said storage chambers defined by said first and second housings.

10. The storage unit of claim 9, wherein each said applicator member includes a sponge.

* * * * *